United States Patent [19]

Jankovsky

[11] 4,442,870

[45] Apr. 17, 1984

[54] BRAKE FOR A GRIPPER PROJECTILE OF A WEAVING MACHINE

[75] Inventor: Frantisek Jankovsky, Winterthur, Switzerland

[73] Assignee: Sulzer Brothers Limited, Winterthur, Switzerland

[21] Appl. No.: 318,612

[22] Filed: Nov. 5, 1981

[30] Foreign Application Priority Data

Nov. 7, 1980 [CH] Switzerland ..... 8275/80

[51] Int. Cl.³ ..... D03D 49/54

[52] U.S. Cl. ..... 139/185; 188/381

[58] Field of Search ..... 139/185, 439; 188/271, 188/279, 297, 322.11, 381, 382

[56] References Cited

U.S. PATENT DOCUMENTS

| | | | |
|---|---|---|---|
| 3,382,955 | 5/1968 | Deyerling | 188/381 X |
| 3,628,633 | 12/1971 | Meeks | 188/381 |
| 3,690,413 | 9/1972 | Airheart | 188/381 |
| 3,875,974 | 4/1975 | Rambousek | 139/185 X |
| 3,886,724 | 2/1975 | Hollnagel | 188/381 X |
| 3,901,288 | 8/1975 | Benedict et al. | 139/185 |
| 3,990,542 | 11/1976 | Dent et al. | 188/381 X |

*Primary Examiner*—Duane A. Reger

*Attorney, Agent, or Firm*—Kenyon & Kenyon

[57] ABSTRACT

The brake is constructed of a clamp-shaped receiving member into which a gripper projectile penetrates during an initial braking stage. The receiving member is, in turn, slidably mounted between two brake shoes which carry out a further braking action. The complementary braking surfaces of the receiving member and brake shoes may be tapered in order to increase the braking action on the moving receiving member.

7 Claims, 8 Drawing Figures

Fig.1
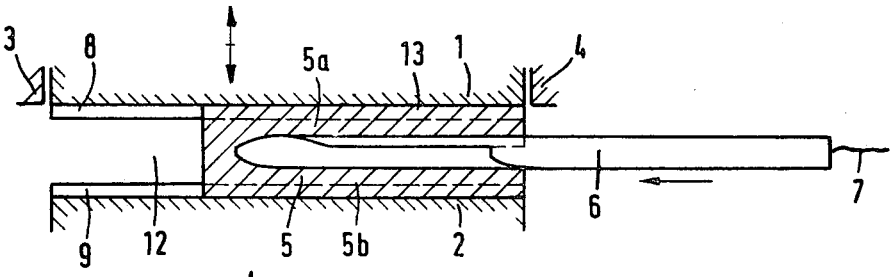
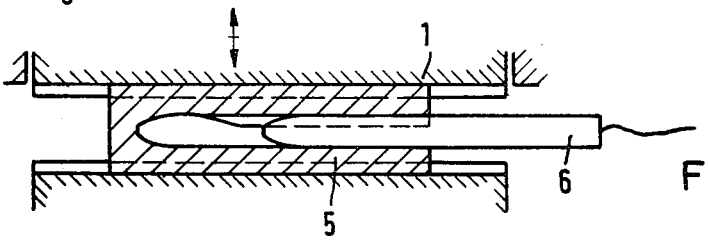
Fig.2
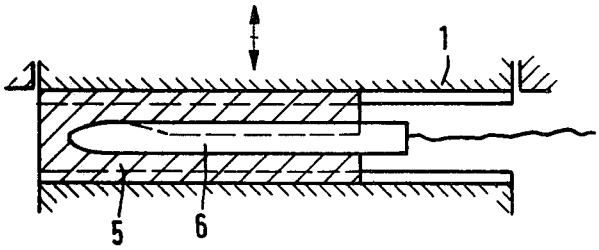
Fig.3
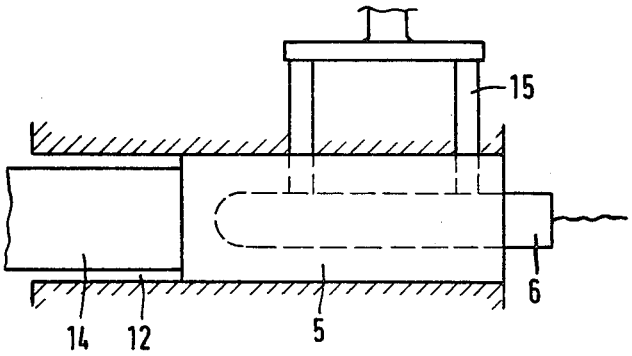
Fig.4

BRAKE FOR A GRIPPER PROJECTILE OF A WEAVING MACHINE

As is known, weaving machines which employ gripper projectiles for the insertion of weft yarns in sheds of warp yarns generally employ a catching mechanism in order to arrest the motion of the gripper projectile at the completion of a picking operation. Generally, the catching devices employ a brake having brake linings for catching and braking the gripper projectiles to a standstill. However, because of the higher flying speed of the projectiles caused by a higher frequency of weft yarn insertion in present day high speed weaving machines, an intense heating of the brake linings of the brake has been created. As a result, there has been greater wear in the brake linings. This, in turn, leads to a need for replacing the brake linings or to adjustments in the brakes from time to time. In addition, the reliability of the brakes may become impaired with respect to the position at which the gripper projectiles are brought to a standstill.

Accordingly, it is an object of this invention to provide a brake for a weaving machine employing gripper projectiles which is able to dissipate the heat generated during a braking operation.

It is another object of the invention to dissipate the heat generated during a braking operation of a gripper projectile in a high speed weaving machine.

It is another object of the invention to increase the useful life of a brake for a gripper projectile in a weaving machine.

Briefly, the invention provides a brake for a gripper projectile of a weaving machine which is comprised of a clamp-shaped receiving member for catching a moving gripper projectile and a pair of brake shoes for slidably receiving the receiving member therebetween.

The brake is constructed such that the braking surfaces of the brake are enlarged. As a result, better heat removal is obtained due to the enlargement of the braking surfaces. In this regard, the work of deceleration initially occurs between the projectile and the receiving member and then between the receiving member and the brake shoes.

The brake shoes can be constructed in various forms so as to arrest the motion of the receiving member therebetween. For example, in one embodiment, one of the brake shoes may have a tapered braking surface which converges toward the other brake shoe while the receiving member has a surface facing and parallel to this tapered braking surface. In another embodiment, a pair of brake shoes may be disposed sequentially with the second of the brake shoes having a tapered braking surface. In this embodiment, the receiving member may also have a surface parallel to the tapered braking surface of the brake shoe.

In still another embodiment, the receiving member may be of rectangular shape with bevelled edges while the brake shoes each have a pair of bevelled guide ledges extending parallel to the bevelled edges of the receiving member.

These and other objects and advantages of the invention will become more apparent from the following detailed description taken in conjunction with the accompanying drawings wherein:

FIG. 1 illustrates a cross-sectional view of a brake constructed in accordance with the invention and with a gripper projectile initially entering into the receiving member;

FIG. 2 illustrates a view similar to FIG. 1 with the projectile further entrained in the receiving member;

FIG. 3 illustrates a view similar to FIGS. 1 and 2 with the receiving member in a standstill position;

FIG. 4 illustrates a top view of the brake of FIG. 1;

Referring to FIG. 1, the brake is mounted, for example, on the catching side of the weaving machine (not shown). As illustrated, the brake includes a clamp-shaped receiving member 5 for catching a moving gripper projectile 6 and a pair of brake shoes 1,2 for slidably receiving the receiving member 5 therebetween.

Figure 5:
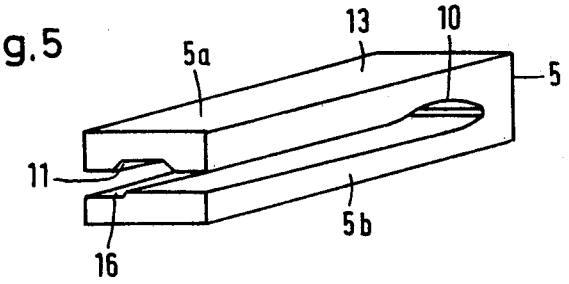
FIG. 5 illustrates a perspective view of the receiving member of the brake.

Referring to FIGS. 1 and 5, the receiving member 5 has a pair of legs **5*a*, 5*b* which are joined together in a fork-like manner in order to define a recess within which the gripper projectile 6 may be caught. In addition, the leg 5*a* is tapered locally at a position 10 adjacent to the juncture between the legs 5*a*, 5*b* so that the member 5 is somewhat elastic in a closing direction and, hence, spreadable. Alternatively, instead of tapering the leg 5*a*, the material may be made of a material which provides a sufficient degree of elasticity. In addition, the leg 5*a* has a longitudinal groove 11 for guiding of the gripper projectile 6. The other leg 5*b* has a longitudinally extending shoulder 16** for purposes which will be described below.

Referring to FIG. 1, the upper brake shoe 1 is moveably mounted so as to move transversely relatively to the opposite brake shoe 2 which is fixedly mounted. As indicated, the moveable brake shoe 1 is guided between a pair of guides 3, 4 so as to move in a vertical plane, as viewed. In addition, both brake shoes, 1, 2 are provided with guide ledges 8, 9 which extend along the path of the gripper projectile 6. Also, both brake shoes 1, 2 are positioned to provide a tunnel or passage 12 for the reception of the receiving member 5.

During operation, the receiving member 5 is positioned at the entrance of the tunnel 12 with the upper brake shoe 1 lying above the receiving member 5 to leave a small clearance. When a gripper projectile 6 having a weft yarn 7 trailing therefrom penetrates into the receiving member 5, the legs **5*a*, 5*b* are spread open until the upper surface 13 of the leg 5*a* presses against the brake shoe 1. At the same time, as the projectile 6 penetrates farther into the receiving member 5, the receiving member begins to move within the tunnel 12. As this occurs, the receiving member 5 is increasingly clamped between the brake shoes 1, 2 with a consequent braking action occurring. Of note, this braking action can be increased by having the upper brake shoe 1** press against a spring (not shown).

The receiving member 5, with the gripper 6 gripped therein, comes to a standstill at the end of the tunnel 12 as shown in FIG. 3. At this time, the projectile 6 can be pushed back in a known manner by a push back means 14 (see FIG. 4) into a desired position with a simultaneous tensioning of the weft yarn 7. In this position, a receiving member 5 is again at the entrance of the tunnel 12. At this time, the upper brake shoe 1 is moved to an open position by suitable means (not shown) so that the receiving member 5 may spread open sufficiently under the action of the projectile. After the weft yarn 7 has been cut, the projectile 6 is expelled from the receiving member 5 in a transverse direction by an ejector 15 via the shoulder 16 in the leg 5*b*.

By having the gripper projectile 6 caught within a receiving member 5 which, in turn, is slidable between two braking shoes, larger braking surfaces are provided such that the heat of braking is dissipated more quickly.

Figure 6:
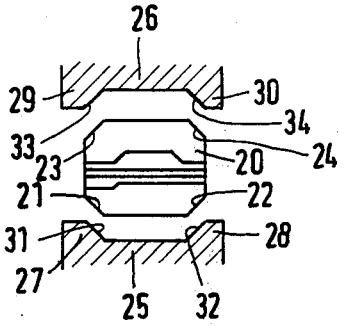
FIG. 6 illustrates an end view of a modified brake constructed in accordance with the invention.

Referring to FIG. 6, a larger heat removal surface can be obtained by increasing the braking surfaces. For example, as shown in FIG. 6, the receiving member 5 has a rectangular cross-section and bevelled edges 21, 23, 23, 24. In like manner, the brake shoes 25, 26 each have a pair of guide ledges 27, 28 and 29, 30 each of which has an inside surface 31, 32, and 33, 34 which is bevelled to extend parallel to the bevelled edges 21–24. For the sake of clarity, the brake shoes 25, 26 are shown in a separated position from the receiving member 20. During operation, the bevelled edges 21–24 of the receiving member 20 would slide along the bevelled guide edges 27–30 of the brake shoes while the surfaces of the legs of the receiving member would slide along the surfaces of the brake shoes 25, 26.

Figure 7:
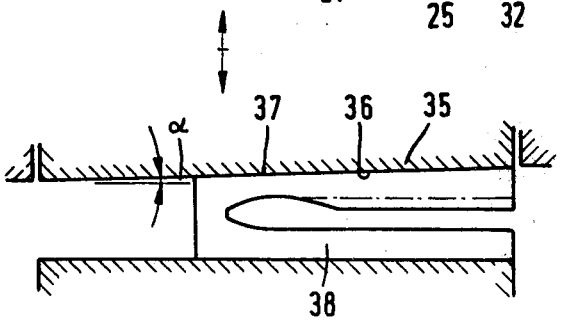
FIG. 7 illustrates a modified brake having a tapered braking surface on a brake shoe and a tapered surface on the receiving member in accordance with the invention.

Referring to FIG. 7, the brake may be modified so that the upper moveable brake shoe 35 has a tapered braking surface 37 which faces and converges towards the fixedly mounted brake shoe in a direction away from the receiving member 38. As indicated, the braking surface 36 extends at an angle $\alpha$ relative to a horizontal plane, as viewed. In addition, the receiving member 38 has an upper brake surface 37 which faces and is parallel to the tapered braking surface 36. As indicated, the receiving member 38 is of a wedge shape.

The brake of FIG. 7 operates in a manner similar to that described above with respect to the embodiment of FIGS. 1 to 3. The advantage of this embodiment is that the braking action on the receiving member is greater so that the brake movement of the upper brake shoe 35 can be made smaller.

Figure 8:
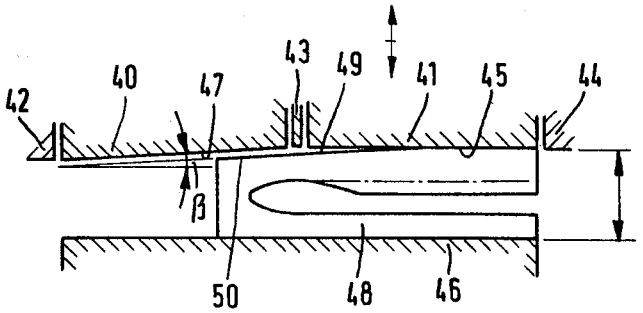
FIG. 8 illustrates a further modified brake having a pair of sequentially disposed brake shoes with the second brake shoe having a tapered braking surface in accordance with the invention.

Referring to FIG. 8, the brake may be constructed with a pair of brake shoes 40, 41 which are sequentially positioned opposite a third brake shoe 46. As indicated, the rear most brake shoe 40 is fixed between a pair of guides 42, 43 while the leading brake shoe 41 is moveably mounted between the guide 43 and a further guide 44. In addition, the brake shoe 41 has a braking surface 45 which extends parallel to a braking surface of the lower brake shoe 46. The brake shoe 40, however, has a braking surface 47 which tapers on an angle $\beta$ such that the braking surface 47 converges toward the brake shoe 46.

The brake also includes a receiving member 48 which has a surface 49 facing the brake shoes 40, 41 with a tapered section 50 which extends parallel to the braking surface 47 of the brake shoe 40.

During operation, as a projectile (not shown) penetrates into the receiving member 48, the member 48 is at first braked between the brake shoes 41, 46. As soon as the tapered section 50 of the receiving member 48 reaches the brake shoe 40, braking of the receiving member 48 between the shoes 40, 46 begins. The advantage of this arrangement is that the initial braking occurs more easily than the final braking stage.

The invention thus provides a brake for a gripper projectile of a weaving machine wherein the heat of braking can be dissipated through enlarged braking surfaces. As a result, wearing of the braking surfaces is reduced and the useful life of the brake can be increased.

What is claimed is:

1. A brake for a gripper projectile of a weaving machine comprising
   a clamp-shaped receiving member for catching a moving gripper projectile; and
   a pair of brake shoes for slidably receiving said receiving member therebetween.

2. A brake as set forth in claim 1 wherein said receiving member has a pair of legs defining a space for receiving a gripper projectile, each said leg having an outer surface for sliding on a respective one of said brake shoes.

3. A brake as set forth in claim 2 wherein one of said legs has a guide groove for receiving a gripper projectile and the other of said legs has a longitudinally extending shoulder.

4. A brake as set forth in claim 1 wherein one of said brake shoes is fixedly mounted and the other of said brake shoes is movably mounted to move transversely relative to said one brake shoe.

5. A brake as set forth in claim 4 wherein said movable brake shoe has a tapered braking surface facing and converging toward said fixedly mounted brake shoe in a direction away from said receiving member, and said receiving member has a surface facing and parallel to said tapered braking surface.

6. A brake as set forth in claim 1 which further comprises a third brake shoe having a tapered braking surface facing and converging toward one of said pair of brake shoes and wherein said receiving member has a surface facing and parallel to said tapered braking surface.

7. A brake as set forth in claim 1 wherein said receiving member has a rectangular cross-section and bevelled edges and said brake shoes each have a pair of bevelled guide ledges extending parallel to respective bevelled edges of said member.

* * * * *